US007256692B2

(12) United States Patent
Vatsaas et al.

(10) Patent No.: US 7,256,692 B2
(45) Date of Patent: Aug. 14, 2007

(54) ANTI-TAMPER APPARATUS

(75) Inventors: Richard D. Vatsaas, Eagan, MN (US); David B. Erickson, Farmington, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 160 days.

(21) Appl. No.: 11/021,646

(22) Filed: Dec. 23, 2004

(65) Prior Publication Data

US 2006/0152360 A1 Jul. 13, 2006

(51) Int. Cl.
*G08B 13/00* (2006.01)

(52) U.S. Cl. ..... 340/550; 340/540; 307/116; 307/147

(58) Field of Classification Search ..... 340/540, 340/550; 307/147, 116
See application file for complete search history.

(56) References Cited

U.S. PATENT DOCUMENTS 3,594,770 A * 7/1971 Ham et al. ..... 340/550
3,825,920 A * 7/1974 Nelson et al. ..... 340/550
3,947,837 A * 3/1976 Bitterice ..... 340/550
4,232,310 A * 11/1980 Wilson ..... 340/550
4,293,778 A * 10/1981 Williams ..... 307/147
4,578,670 A * 3/1986 Joergensen ..... 340/550
4,999,608 A * 3/1991 Galomb ..... 340/550
5,027,397 A * 6/1991 Double et al. ..... 713/194
5,298,884 A 3/1994 Gilmore et al. ..... 340/573
5,448,221 A 9/1995 Weller ..... 340/539
5,450,888 A * 9/1995 Schwartzman et al. ..... 160/10
5,476,731 A 12/1995 Karsten et al. ..... 429/97
5,568,124 A * 10/1996 Joyce et al. ..... 340/550
5,610,582 A * 3/1997 Zahn et al. ..... 340/550
5,689,243 A 11/1997 Bianco ..... 340/825.3
5,877,703 A 3/1999 Bloss, Jr. et al. ..... 340/870.02
6,076,050 A 6/2000 Klein ..... 702/188
6,111,519 A 8/2000 Bloss, Jr. et al. ..... 340/870.02
6,400,267 B1 6/2002 Gordon-Levitt et al. .... 340/547
6,998,981 B1 * 2/2006 Montague ..... 340/540
2003/0009683 A1 1/2003 Schwenck et al. ..... 713/194

* cited by examiner

*Primary Examiner*—Jeffery Hofsass
*Assistant Examiner*—Edny Labbees
(74) *Attorney, Agent, or Firm*—Brooks, Cameron & Huebsch, PLLC

(57) ABSTRACT

One apparatus embodiment includes a patterned electrically conductive layer, a power source, and an actuator. The power source provides an electrical signal to the electrically conductive layer. The monitoring unit monitors the electrical signal and initiates an action based upon a change in the electrical signal.

18 Claims, 5 Drawing Sheets

ANTI-TAMPER APPARATUS

FIELD OF THE INVENTION

The present disclosure generally relates to anti-tamper structures. And, in particular, the present disclosure relates to protecting objects through use of an anti-tamper apparatus.

BACKGROUND

There are many contexts and technological fields that involve information, materials, systems, and/or devices that should not be tampered with. For example, in some situations, if an item is interacted with, such as by touching or moving the item, the item may be damaged. For instance, sterile materials, when touched, may become contaminated based upon their interaction with an individual or object coming in contact with the materials.

In other instances, the interaction with the item may cause harm to an individual or object interacting with it. For example, in some instances an individual can come in contact with a chemical, biological, or radioactive substance that can damage the object or individual.

Additionally, in some military and/or business contexts, certain information, materials, systems, and/or devices should not be viewed or obtained by unauthorized personnel. For example, in a business context, software, firmware, biological materials, and the like, may be proprietary or contain proprietary information that may be useful to a competitor. In a military context, captured vehicles or armaments may include information, materials, systems, and/or devices that may benefit an opposing force.

In many instances, a secured enclosure is used to keep unauthorized individuals away from such items. For example, vaults and lock boxes having reinforced walls have been used to deter unauthorized individuals from accessing the contents of these enclosures. However, in some situations, such measures may not be sufficient to deter these individuals. For instance, when a vehicle is captured by an opposing force, the force may be able to take a long period of time and have tools on hand to overcome such security measures. Additionally, in these situations, the occupants have been restrained such that they cannot destroy the sensitive items being protected. Therefore, if the opposing force overcomes the security measures, the items will likely still be intact for study and/or use.

SUMMARY

The present disclosure provides a number of anti-tamper apparatus embodiments. For example, in one embodiment an apparatus includes an electrically conductive layer, a power source, and an actuator. The electrically conductive layer can be uniformly patterned. In some embodiments, such as some embodiments having a uniform patterned electrically conductive layer, the layer can be constructed such that the layer has a predictable resistance and/or capacitance across the layer. These embodiments can be beneficial, for example, because the resistance and/or capacitance of the patterning can be calculated and used to locate a breakage in the conductive layer or contact made with the layer.

In some embodiments, the electrically conductive layer is provided in the form of a grid. For example, the uniform patterned electrically conductive grid can be a mesh. In some embodiments, the mesh can have conductive paths that are organized in a predictable pattern. In such embodiments, the resistance and/or capacitance of the layer can be predictable and, therefore, the location of a point of contact with or a point of breakage of the conductive layer can be determined.

The power source provides an electrical signal to the electrically conductive layer. The power source can be of any type including, but not limited to, battery, solar, wired electrical, and/or atomic power sources and can include various types of alternating current and/or direct current power sources. Additionally, in various embodiments, an apparatus can have multiple power sources and can include a primary and backup power source.

In some embodiments, the power source for providing an electrical signal to the electrically conductive layer can provide an irregular electrical signal. Such embodiments can be beneficial in instances where an unauthorized individual attempts to bypass the electrically conductive layer, or a portion thereof.

The actuator can be used to initiate an action based upon a change in the electrical signal passing through the electrically conductive layer. For example, a change in the electrical signal can include a change in the voltage and/or the current. For instance, in various embodiments, the resistance and/or capacitance of the electrically conductive layer or a portion thereof can be monitored and when a change occurs, the change can be identified and an action can be initiated.

In various embodiments, a number of actions can be taken by an anti-tamper apparatus. Actions that can be initiated in various embodiments can include recording information about the change. The recorded information, for example, can include date, time, atmospheric conditions, quantity of the change, duration of the change, whether the change was due to contact or breakage of the conductive layer.

Another action that can be provided is initiating an alert signal such as an audible, physical, or visual signal. Signals can include voice, text, images, light, other audible sounds, vibrations, and the like.

The initiating of an action can also include a mechanism to indicate damage to the electrically conductive layer. In some embodiments, the mechanism can indicate the location of the damage on the electrically conductive layer. Such embodiments can be beneficial, for example, when used in a vehicle to indicate where the vehicle has been damaged. For instance, one or more anti-tamper apparatuses can be positioned within a vehicle. (e.g., one or more portions or all of the skin of a vehicle can include an electrically conductive layer).

In embodiments having one electrically conductive layer, various numbers of connections to the monitoring device can be used to identify the position of damage or contact on the electrically conductive layer. In embodiments where multiple electrically conductive layers are used, each electrically conductive layer can represent a position and, therefore, a change identified with respect to a particular electrically conductive layer can indicate damage or contact at the position of the particular electrically conductive layer. Such embodiments can also use various numbers of connections to a monitoring unit in order to pinpoint the location of the damage or contact.

In various embodiments, the actions that can be initiated are to alter the item being protected with the anti-temper apparatus. Examples of actions can include, but are not limited to, erasing computer executable instructions, supplying an electrical charge to the item, mixing of a chemical solution, and the spraying of a chemical solution on the item being protected, among others. Such actions can be used to disable, destroy, and/or damage the item being protected.

These actions can, therefore, be useful when the item is being accessed by an unauthorized individual and where the item being protected should not be accessed by the individual in an operational condition, for example. Such actions can be used for the protection of biological items, chemical items, electrical items, and radioactive items, to name a few.

Apparatus embodiments can come in various forms. For example, apparatus embodiments, can be in the form of a container for one or more items, a portion of a container, or attached to a container or an item, among others.

In various embodiments, the electrically conductive layer forms a periphery within which an item to be protected can be positioned. In some embodiments, the power source, monitoring unit, and actuator can be oriented within the periphery. Such an arrangement can be beneficial in that these components, that an individual may try to access in order to disable the anti-tamper apparatus, are located within the periphery of the electrically conductive layer.

In some embodiments, the power source, monitoring unit, and actuator can be provided within a housing. The housing can also include anti-tamper measures thereon. In such embodiments, the housing can be provided within the periphery of the electrically conductive layer or outside the periphery.

The electrically conductive layer, in some embodiments, can be encapsulated within a sheet of material. The sheet of material can be a wall of a container, a sheet of material with the electrically conductive layer formed therein, or a laminate sheet, for example, and can be rigid or flexible, in some embodiments.

A container can include structures having one or more walls that surround an object to an extent of 90 degrees around the object in one dimension, for example. By forming or placing the electrically conductive layer into a wall of a container, the container can be manufactured with the anti-tamper functionality already available when an item is stored within the container. Additionally, such embodiments may be more difficult for an unauthorized individual to compromise because the anti-tamper apparatus is positioned within a wall and may be difficult to access.

Embodiments where the sheet of material is a laminate sheet or other type sheet, the sheet embodiments can be inserted into a container protecting an item or around an item. Such embodiments can be beneficial, for example, in situations where the container has already been fabricated, where manufacturing the anti-tamper apparatus within a wall of the container is difficult or not cost effective, or when an anti-tamper apparatus is to be added to a structure that does not have an anti-tamper functionality, among others.

In some embodiments, at least a portion of an outer surface of the sheet of material can include an attachment medium for attachment of the sheet of material to a surface. For example, the medium for attachment can be a hook or loop type surface for hook and loop attachment to a container or an item. The medium for attachment can also be a type of adhesive. The adhesive can be a permanent adhesive or a releasable adhesive. Holes or loops, for tying down the material, or magnetic attachment mechanisms are other examples, of mediums that can be used for attachment. Such embodiments can thereby be applied to the surfaces of containers or to items to be protected.

Various embodiments can also include a monitoring unit for monitoring the electrical signal. For example, the monitoring unit can compare an electrical signal sent through the electrically conductive layer with the original electrical signal value. In various embodiments, the resistance and/or capacitance of the electrically conductive layer can be monitored for changes.

The monitoring unit can be used in conjunction with an actuator for initiating an action based upon information received from the monitoring unit. For example, computer executable instructions can be used to determine when to signal the actuator to initiate an action. In such embodiments, the actuator can initiate an action based upon information received from the monitoring unit. In some embodiments, the functionalities of the monitoring unit and the actuator can be provided by one component of the apparatus.

Monitoring units can be provided to monitor current and/or voltage of the electrical signal. The monitoring unit can also take into account a number of variables that may affect the electrical signal. The variables can include temperature, humidity, atmospheric salt content, electromagnetic field, and age of the materials used to fabricate the anti-tamper apparatus, for example. In embodiments where an irregular electrical signal is provided, the changes in the signal can be provided to the monitoring unit such that the unit can account for such changes.

This can be accomplished, for example, by circuitry and/or by having a processor and memory within or attached to the monitoring unit. Computer executable instructions can be provided in the memory and executable by the processor to communicate with the power source to obtain the irregular electrical signal. In such embodiments, the power source can also include circuitry and/or a processor and memory with computer executable instructions for changing the electrical signal in an irregular manner. Some embodiments can include tables or algorithms for identifying the changes in the irregular electrical signal.

In some embodiments, the circuitry and/or computer executable instructions for determining when to signal the actuator to initiate an action can include logic to allow an authorized user to disable the anti-tamper apparatus. In this way, the apparatus can be disabled in situations where an authorized individual has to access the protected item. For example, firmware or software within the item may have to be updated or installed, a chemical or biological item may have to be removed without its destruction, a protected item has to be repaired or undergo maintenance, and other such instances.

DETAILED DESCRIPTION

The present disclosure includes a number of anti-tamper apparatus embodiments. Embodiments of the present disclosure will now be described in relation to the accompanying drawings, which will at least assist in illustrating the various features of the various embodiments.

Figure 1:
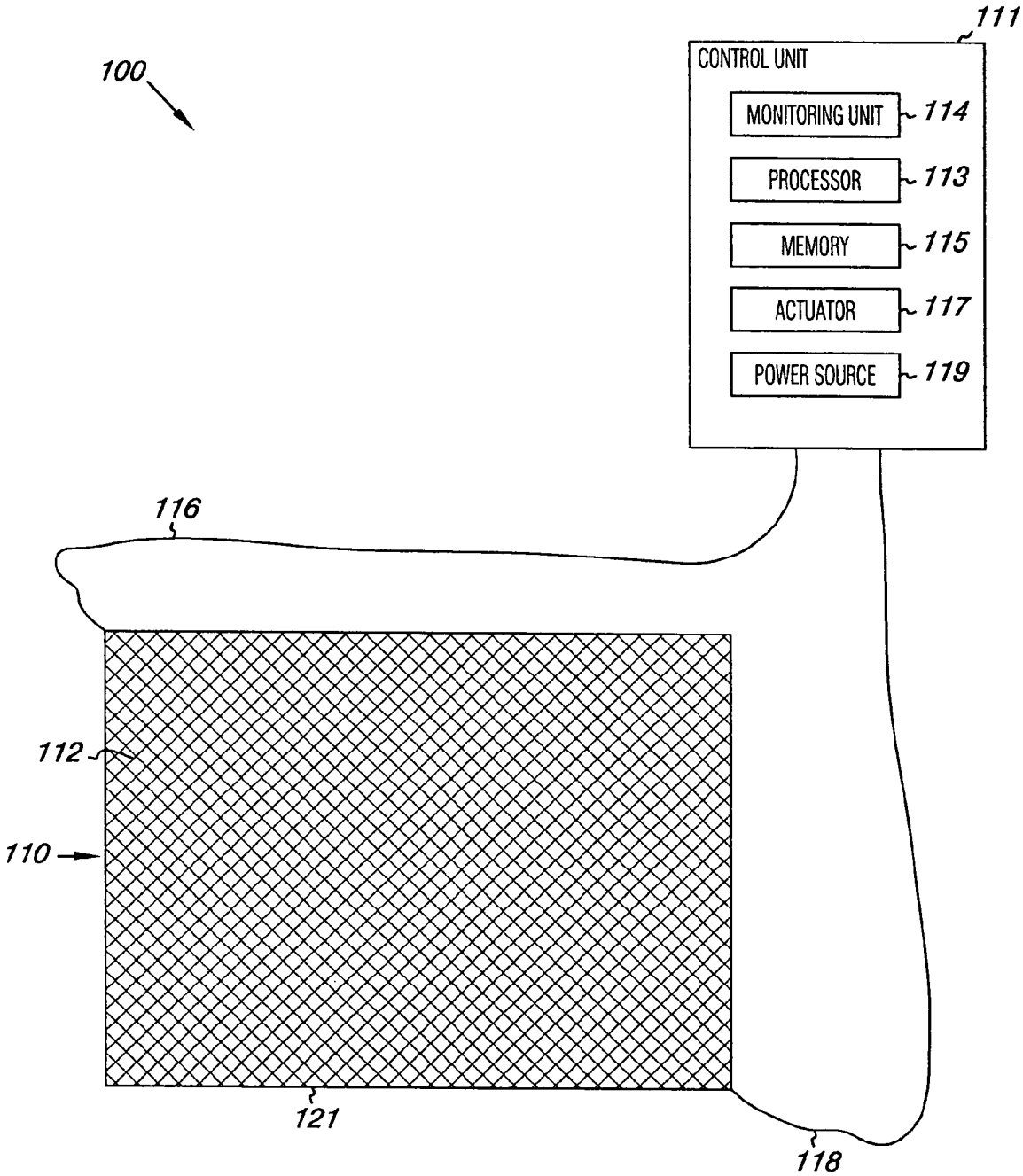
FIG. 1 is an illustration of an embodiment of an anti-tamper apparatus.

FIG. 1 is an illustration of an embodiment of an anti-tamper apparatus. The embodiment shown in FIG. 1 illustrates an anti-tamper apparatus 100 having an electrically conductive layer 110 connected to a control unit 111.

In the embodiment shown in this figure, the electrically conductive layer 110 is formed from a number of conductive paths 112. The conductive paths 112 can be formed in any manner. For example, the conductive paths 112 can be wires or cables; stamped, etched, or deposited conductive layers; and/or other such conductive paths. In some instances, the various conductive paths 112 can overlap. In such instances, the conductive layer 110 can be thicker in some areas than in others.

The control unit 111 includes a monitoring unit 114, a processor 113, memory 115, an actuator 117, and a power source 119. Although shown as one unit, the monitoring unit, processor, memory, actuator, and power source can all be provided as one or more separate units.

The monitoring unit 114 can be used to monitor the electrical signal passing through the electrically conductive layer 110 as will be discussed in more detail below. Processor 113 can be used to execute computer executable instructions that are stored in memory, such as in memory 115. Memory 115 provides storage for computer executable instructions and data, such as data used in executing the computer executable instructions. Memory can include ROM, RAM, and flash memory types, among others. In various embodiments, a processor and/or memory can be provided within the monitoring unit 114, actuator 117, and/or power source for providing one or more of the various functions described herein.

The connection of between electrically conductive layer 110 and the control unit 111 can be accomplished in any manner. For example, in FIG. 1, the connection is accomplished through the use of wires 116 and 118. However, in various embodiments, the connection can be accomplished in other suitable ways, such as by other types of conductive paths.

Additionally, in some embodiments, the connection can be wireless. For example, the control unit can be part of a supermarket checkout system and can include a scanner, where the scanning action or other voltage/current source can send voltage and/or current through the electrically conductive layer. The resistance and/or capacitance, for example, can then be measured and compared to a value stored in memory. Radio frequency identification (RFID) signals are one example of a type of wireless signal that may be used in such embodiments. Such embodiments can be used to identify if a product has been opened or otherwise tampered with, for instance.

Additionally, the electrically conductive layer 110 and the control unit 111 can be connected various numbers of times. For example, in FIG. 1, the electrically conductive layer 110 and the control unit 111 are connected twice (i.e., once by 116 and once by 118).

Different numbers of connections can be beneficial, for example, in embodiments where the location of the contact or breakage of the electrically conductive layer is to be identified. In such embodiments, different numbers of connections can change the accuracy of the location identified by the monitoring unit.

For example, in the embodiment of FIG. 1, the two connections are made with two corners of the electrically conductive layer 110. Since the pattern of the electrically conductive layer 110 is uniform (i.e., a mesh formed of conductive paths oriented at 90 degree angles forming square apertures), the resistance and/or capacitance can be determined across the electrically conductive layer. In various embodiments, other uniform and non-uniform patterns having predictable resistance and/or capacitance.

When contact or breakage occurs at a location, the proximity to each of the connection points of 116 and 118 can be determined. With two connection points oriented at two of the corners of the sheet, the location of the contact or breakage can be identified by a general proximity to each of the connection points, but the exact location may be difficult to determine. If connections are made to three of the corners or to all of the corners of the electrically conductive layer, then the accuracy of the location identified by the monitoring unit would increase.

When each of the conductive paths is connected to the control unit, the accuracy of the location identified by the monitoring unit can be even higher. Additionally, in some embodiments, such as that shown in FIG. 1, the electrically conductive layer can include edges 121 that bound the electrically conductive layer 110 (e.g., in contrast to the electrically conductive layers illustrated in FIGS. 2 and 3). In such embodiments, the connections with the control unit can be made to the edges 121 of the electrically conductive layer, rather than to the individual conductive paths or the corners or other contact points on the electrically conductive layer.

Figure 2:
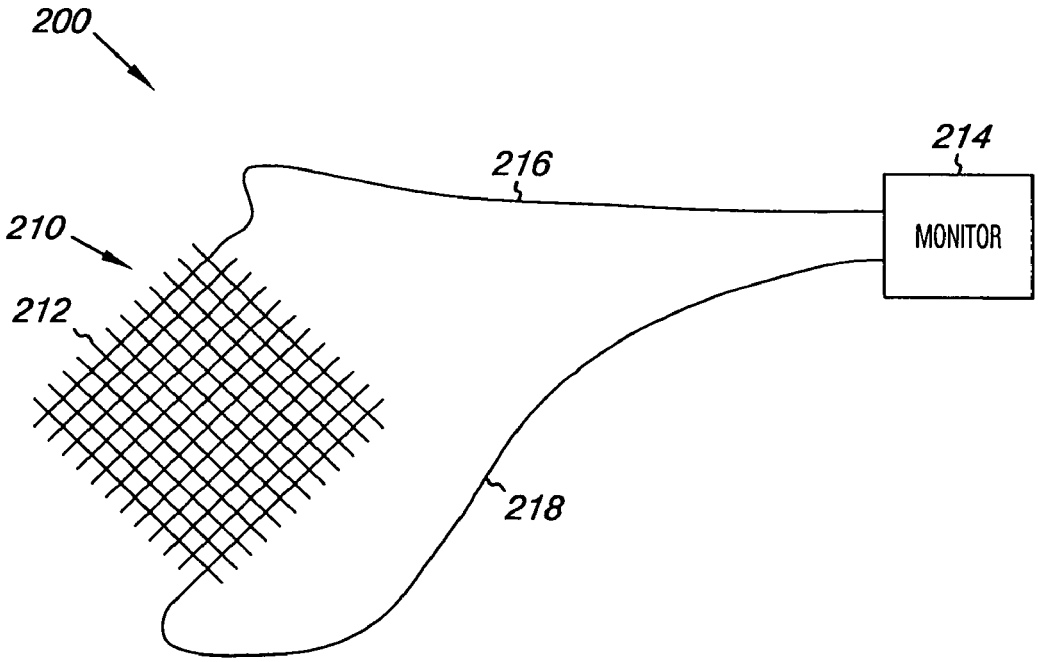
FIG. 2 is an illustration of another embodiment of an anti-tamper apparatus.

FIG. 2 is an illustration of another embodiment of an anti-tamper apparatus. In the embodiment shown in FIG. 2, the anti-tamper apparatus 200 includes an electrically conductive layer 210 connected to a monitoring unit 214. In the embodiment shown in this figure, the electrically conductive layer 210 is formed from a number of conductive paths 212. The connection between the electrically conductive layer 210 and monitoring unit 214 is accomplished by conductive paths 216 and 218.

In such embodiments, the monitoring unit 214 can include the functionality of providing the power source for the anti-tamper apparatus 200 to the electrically conductive layer 210. For example, an electrical signal can travel through conductive path 216, through electrically conductive layer 210 via conductive paths 212, and through conductive path 218, back to the monitoring unit 214.

The monitoring unit 214 can compare the voltage and/or current that has returned to the monitoring unit 214 via conductive path 218 to the original voltage and/or current of the electrical signal sent via conductive path 216 to the electrically conductive layer 210. The function of comparing the voltage and/or current can be provided by circuitry, computer executable instructions, or a combination thereof. In this way, the electrically conductive layer can be monitored for changes that occur, such as those due to contact with the electrically conductive layer or from breakage of a conductive path, such as paths 212, 216, and/or 218, as will be discussed in more detail below with respect to FIG. 3.

Figure 3:
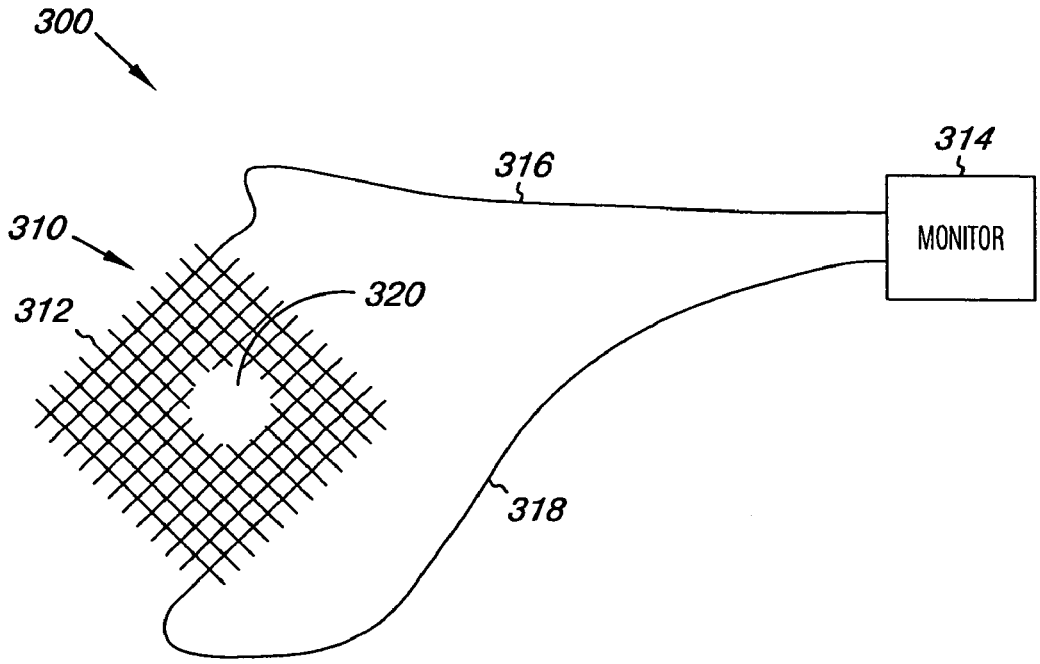
FIG. 3 is an illustration of the anti-tamper apparatus of FIG. 2 that has been compromised by a hole being formed therein.

FIG. 3 is an illustration of the anti-tamper apparatus of FIG. 2 that has been compromised by a hole being formed therein. In the embodiment illustrated in FIG. 3, the anti-tamper apparatus includes an electrically conductive layer 310 connected to a monitoring unit 314. The electrically conductive layer 310 is formed from a number of conductive paths 312. These components are similar to the components shown in FIG. 2.

In this example, a hole 320 has been formed in the electrically conductive layer 310. The hole 320 changes the characteristics of the electrically conductive layer 310. For example, the resistance of the electrically conductive layer 310 with the hole is larger than that of the electrically conductive layer 310 without the hole. By using a monitoring unit 314 that can identify such changes, tampering with the electrically conductive layer can be detected.

The characteristics of the electrically conductive layer 310 also change when an object contacts the electrically conductive layer 310. For example, if a drill or a chemical solution, such as acid, where used to form the hole 320, the contact of the drill or acid with the electrically conductive layer 310, could be detected based upon the change in the characteristics of the electrically conductive layer 310, and by having a monitoring unit 314 used that could identify such changes in the characteristics of the electrically conductive layer 310. Additionally, in some embodiments, the monitoring unit 314 can identify changes in the characteristics of the electrically conductive layer based upon contact by an individual with the electrically conductive layer 310.

Figure 4:
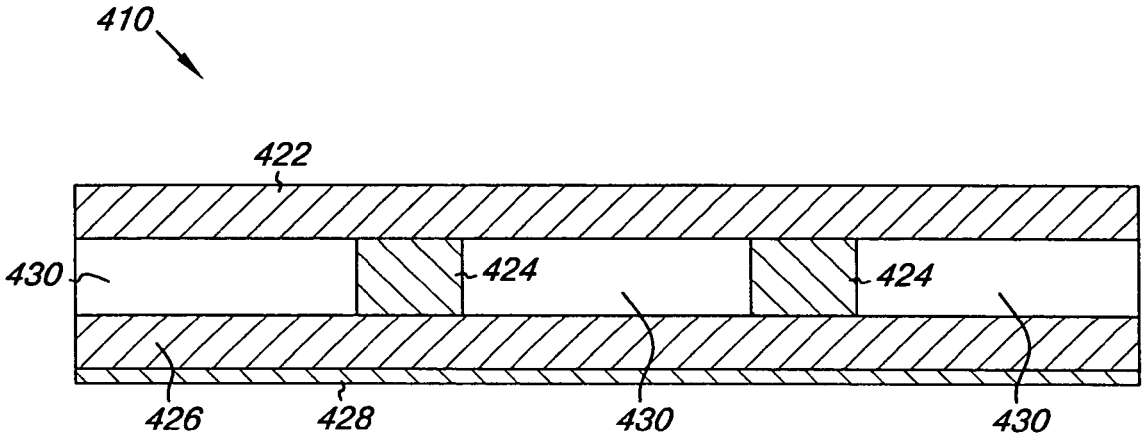
FIG. 4 is an illustration of an embodiment of an anti-tamper appliqué.

FIG. 4 is an illustration of an embodiment of an anti-tamper appliqué. The appliqué embodiment illustrated in FIG. 4 is an anti-tamper apparatus 410 in the form of a sheet of material. In the embodiment shown in FIG. 4, a laminated sheet of material is illustrated and includes an upper laminate layer 422, a lower laminate layer 426, conductive paths 424, spaces 430, and an attachment medium 428.

The structure shown in FIG. 4 can be formed in various ways. For example, the layers can each be formed separately and then assembled into a laminated sheet 410. In some embodiments, the layers can be formed together or created using a deposition process, such as chemical vapor deposition, or other such processes.

As stated above, the attachment layer 428 can include adhesive, hook and loop, magnetic, and/or apertures, among other suitable attachment mediums, for attachment of the appliqué 410 to an object such as a container or an item that is to be protected. In various embodiments, the appliqué 410 can be connected via conductive paths 424 to a monitoring unit, such as monitoring unit 314 illustrated in FIG. 3. The appliqué 410 can also be connected to an actuator for initiating an action based upon changes to the electrical signal passing through the appliqué 410 via conductive paths 424. In various embodiments, the appliqué 410 can be connected to a monitoring unit that can also include the actuator functionality.

Figure 5:
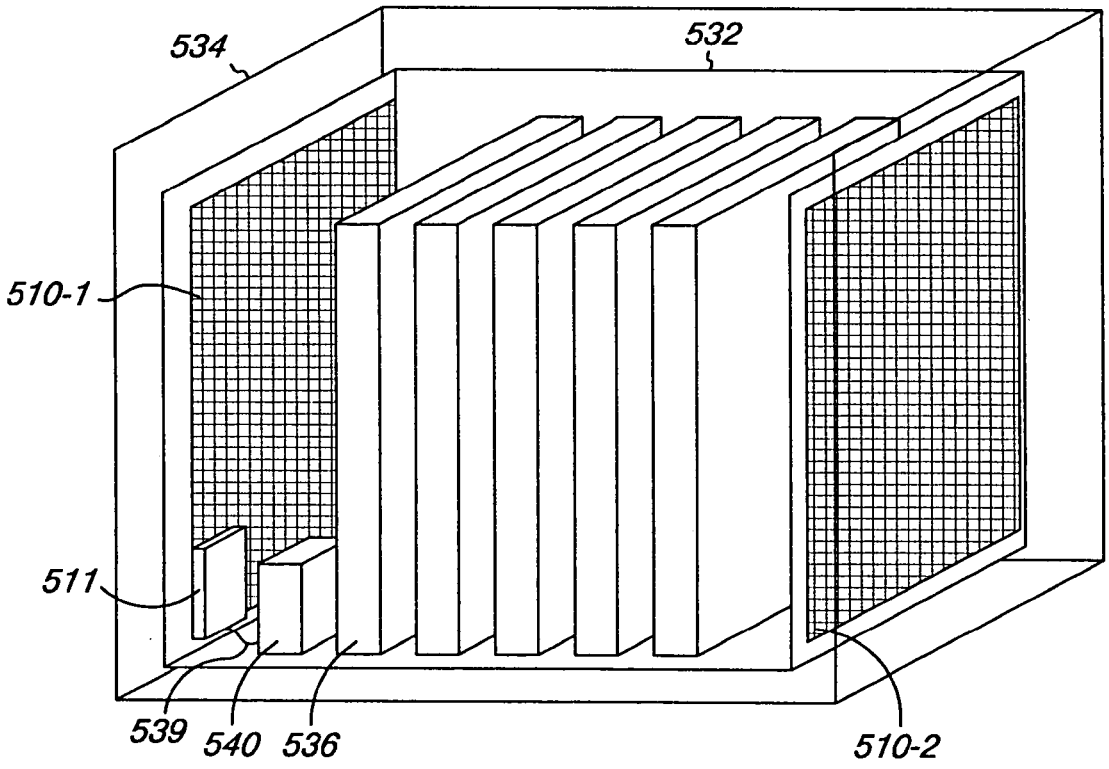
FIG. 5 is an example of an anti-tamper sheet in use.

FIG. 5 is an example of an anti-tamper sheet, such as the appliqué 410 illustrated in FIG. 4, in use. In the embodiment illustrated in FIG. 5, two sheets 510-1 and 510-2 are positioned within container 534. In the embodiment shown, a number of items to be protected 536 are located within the container 534.

Additionally, in the example shown in FIG. 5, the items 536 are positioned within a second container 532 that is positioned within the first container 534. This example allows for the sheets 510-1 and 510-2 to be shown in two different positions. For example, the sheet 510-1 is positioned on the inside of container 532. In this way, an unauthorized individual would not be able to ascertain whether an anti-tamper apparatus had been provided to this security system.

The sheet 510-2 is positioned on the outside of container 532. Such positioning may act as a deterrent to an unauthorized individual by allowing the individual to see the anti-tamper apparatus 510-2. In various embodiments, the sheets 510-1 and 510-2 can be attached to the container 532.

Another benefit to the use of appliqués or other sheet type embodiments is that the anti-tamper functionality can be applied to selected areas, thereby potentially saving costs. For example, if container 534 where only accessible through the left and right walls of the container 534 shown in FIG. 5, then an anti-tamper apparatus having one or more sheets of material or multiple anti-tamper apparatuses in the form of sheets of material could be positioned in front or behind those walls, as apparatuses 510-1 and 510-2 are illustrated as being positioned in FIG. 5, instead of surrounding the items 536 with one or more anti-tamper apparatuses on all sides or surrounding the item to be protected.

FIG. 5 also illustrates an embodiment having a control unit 511 that is connected to the electrically conductive layer of the apparatus 510-1 and connected to a power supply 540 via wire 539. In the embodiment illustrated in FIG. 5, the items 536 are electrical components and the power supply 540 provides power to the items 536. In this embodiment, the control unit 511 includes actuator functionality and when a change in the resistance of the electrically conductive layers of the apparatuses 510-1 or 510-2 is detected, the actuator can signal the power supply 540, via wire 539, to send an electrical charge to the items 536 to disable or destroy the items 536.

In various embodiments used for protecting computer executable instructions or data, the control unit can be connected to the items such that when signaled, the items can delete the computer executable instructions and/or data that are being protected. This can be accomplished by computer executable instructions within the control unit, within the components of the anti-tamper apparatus, within one or more of the items being protected, or computer executable instructions located in a combination of these locations. Accordingly, in some embodiments, the actuator functionality can be provided by the control unit, monitoring unit, actuating unit, another apparatus provided within a container (e.g., power supply 540), and/or one or more of the items being protected.

Figure 6:
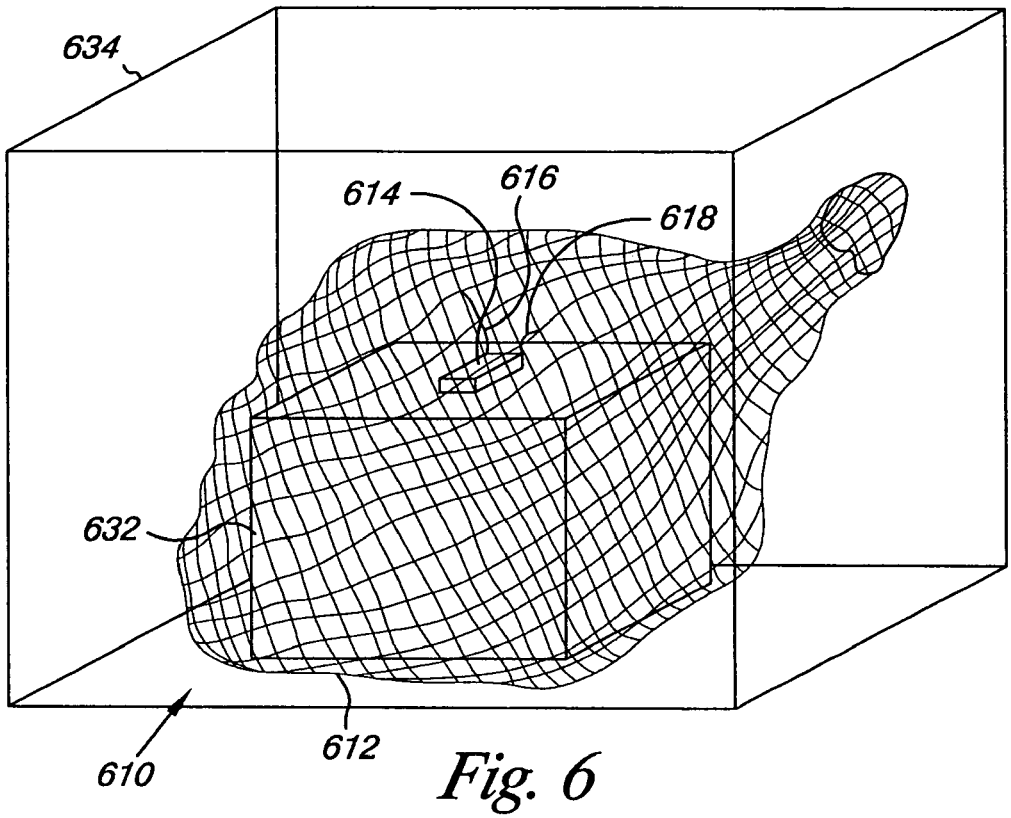
FIG. 6 is another illustration of an embodiment of an anti-tamper apparatus.

FIG. 6 is another illustration of an embodiment of an anti-tamper apparatus. In the embodiment of FIG. 6, the anti-tamper apparatus 610 is a sheet or bag of material that can be used to surround an item 632. This allows for the item 632 to be surrounded without the positioning and/or attachment of a number of sheets of material such as those shown in the embodiment of FIG. 5. In the embodiment shown in FIG. 6, the sheet or bag is constructed of a number of conductive paths 612 such as from wires, cables, or other such suitable materials.

The sheet or bag can also be constructed from a laminated sheet such as that shown and described with respect to FIG. 4. The monitoring unit 614 is positioned within the periphery formed by the conductive paths 612 of the electrically conductive layer 610. Such an embodiment can make it difficult for an unauthorized individual to have access to the monitoring unit 614 without contacting or breaking the conductive paths 612. Additionally, the connections between the monitoring unit 614 and the electrically conductive layer 610 are also positioned within the periphery of the electrically conductive layer 610.

Figure 7:
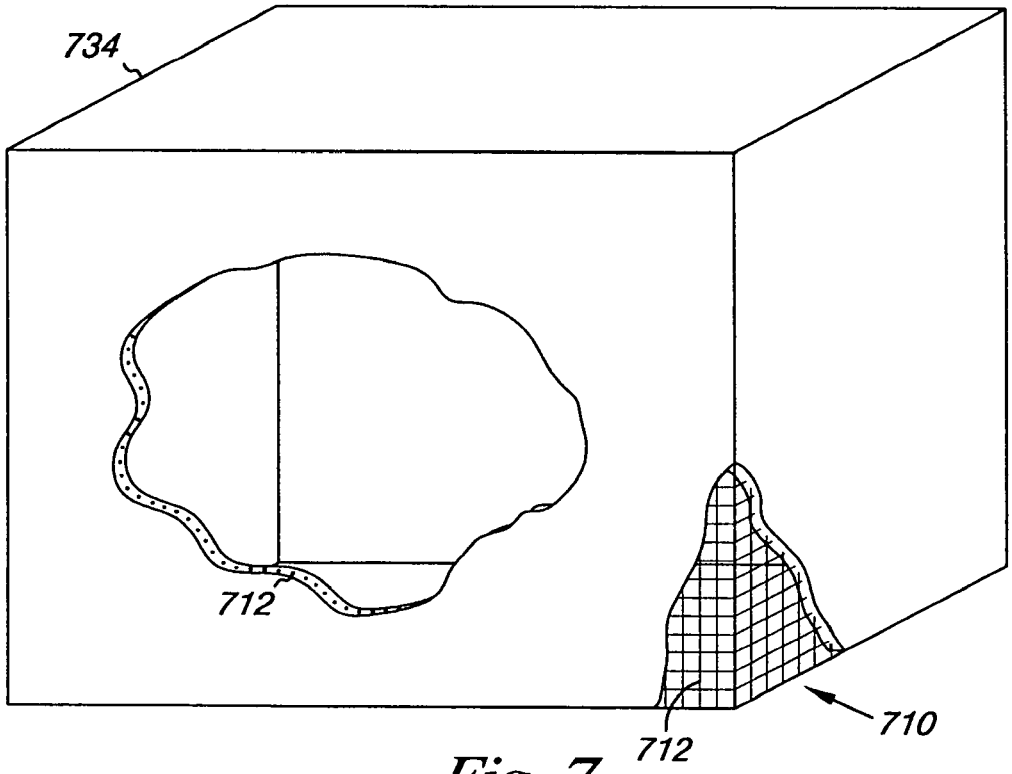
FIG. 7 is an illustration of another embodiment of an anti-tamper apparatus.

FIG. 7 is an illustration of another embodiment of an anti-tamper apparatus. FIG. 7 illustrates a container that can be manufactured with an anti-tamper apparatus 710 formed therein. In this embodiment, the container 734 can be fabricated having a number of walls with the conductive paths 712 formed therein. The conductive paths can be formed in any suitable manner. In various embodiments, such containers can be formed around an item such that the item cannot be accessed unless the electrically conductive layer 710 is compromised.

In some embodiments, the container can include an aperture to allow for an item to be placed within the container 734. In such embodiments, the aperture can then be secured against a surface such that access through the aperture cannot be made by an unauthorized individual.

Figure 8:
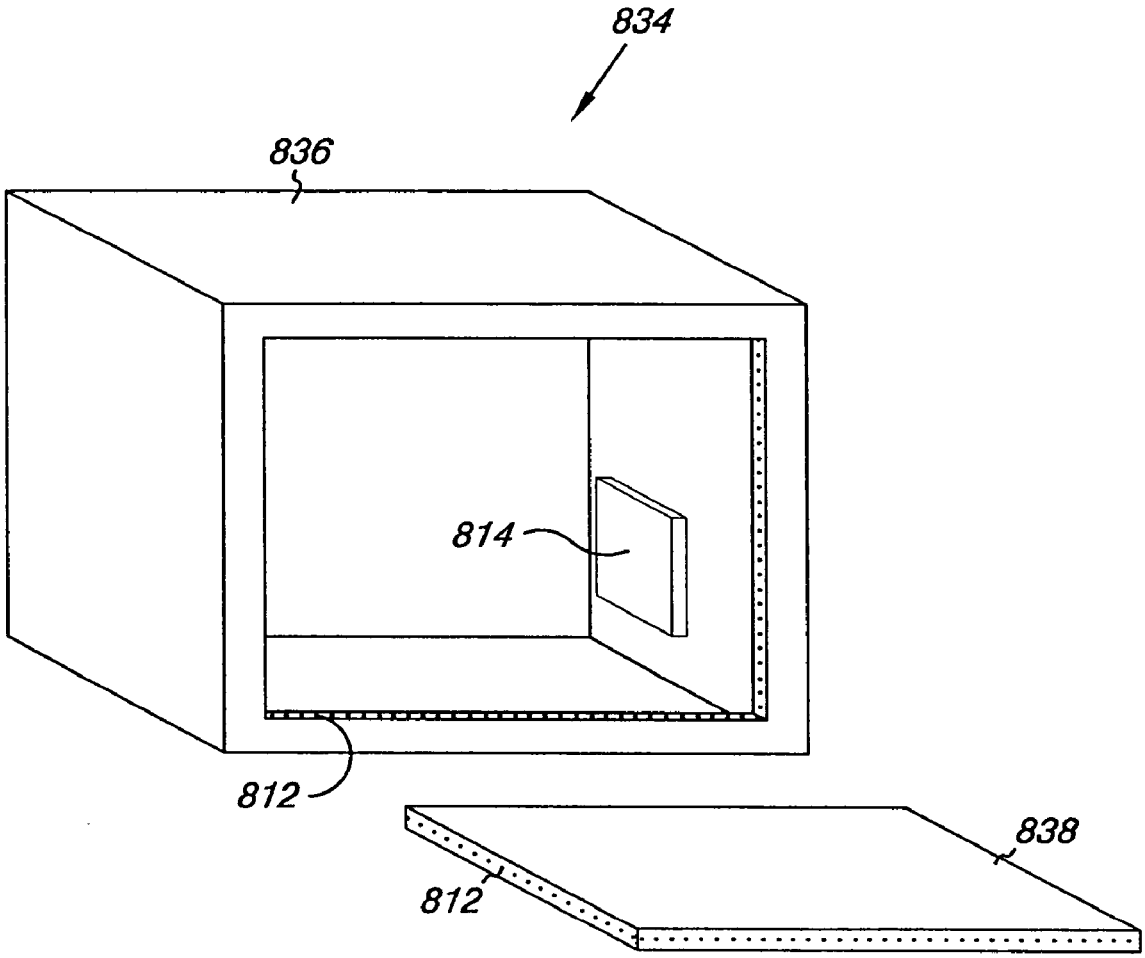
FIG. 8 is an illustration of another embodiment of an anti-tamper apparatus.

FIG. 8 is an illustration of another embodiment of an anti-tamper apparatus. In this embodiment, an aperture is provided in the container 834. The container 834 also includes a cover 838 that is to be secured to the body of the container 836. The container 834 also includes conductive paths formed in the walls of the container 834. In this embodiment, the conductive paths 812 are constructed such that once the cover is positioned in the aperture, the conductive paths on the body of the container 836 connect with those on the cover 838 to surround the entire periphery of the container 834 including the cover 838.

In this way, a cover can be used to access the interior of the container, but once in place, the cover does not allow for access to be made by unauthorized individuals. Additionally, in this embodiment, the monitoring unit 814 is provided within the container 834 making it difficult for an unauthorized individual to gain access to the monitoring unit 814 without contacting or breaking conductive paths 812.

Although specific embodiments have been illustrated and described herein, those of ordinary skill in the art will appreciate that any arrangement calculated to achieve the same techniques can be substituted for the specific embodiments shown. This disclosure is intended to cover adaptations or variations of various embodiments of the invention. It is to be understood that the above description has been made in an illustrative fashion, and not a restrictive one.

Combination of the above embodiments, and other embodiments not specifically described herein will be apparent to those of ordinary skill in the art upon reviewing the above description. The scope of the various embodiments of the invention includes various other applications in which the above structures and methods are used. Therefore, the scope of various embodiments of the invention should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed:

1. An anti-tamper apparatus, comprising:

a patterned electrically conductive layer formed from multiple conductive paths; and encapsulated within a wall surface forming an interior space;

a power source for providing an electrical signal to the electrically conductive layer; and a monitoring unit for monitoring the electrical signal and initiating an action based upon a change in the electrical signal; and wherein the power source for providing an electrical signal to the electrically conductive layer can provide an irregular electrical signal.

2. The apparatus of claim 1, wherein the patterned electrically conductive layer encapsulates an interior space and wherein the power source and monitoring unit are oriented within the interior space formed via the encapsulation by the electrically conductive layer.

3. The apparatus of claim 1, wherein the patterned electrically conductive layer is encapsulated within a sheet of material and wherein at least a portion of an outer surface of the sheet of material includes an attachment medium for attachment of the sheet of material to a surface.

4. The apparatus of claim 3, wherein the medium for attachment is selected from the group including:

a hook surface for hook and loop attachment;

a loop surface for hook and loop attachment;

a permanent adhesive; and a releasable adhesive.

5. The apparatus of claim 1, wherein the patterned electrically conductive layer provides a predictable resistance across the layer.

6. The apparatus of claim 1, wherein the electrical signal to be monitored is a voltage.

7. The apparatus of claim 1, wherein the electrical signal to be monitored is a current.

8. The apparatus of claim 1, wherein the monitoring unit includes computer executable instructions for determining when to signal an actuator to initiate an action.

9. The apparatus of claim 8, wherein the computer executable instructions for determining when to signal the actuator to initiate an action include instructions that take into account variables selected from the group including:

temperature;

humidity;

salt content; and electromagnetic field.

10. The apparatus of claim 8, wherein the computer executable instructions for determining when to signal the actuator to initiate an action include logic to allow an authorized user to disable the anti-tamper apparatus.

11. An anti-tamper apparatus, comprising:

a patterned electrically conductive layer formed from multiple conductive paths; and encapsulated within a wall surface forming an interior space;

a power source for providing an electrical signal to the electrically conductive layer; and means for initiating an action based upon a change in the electrical signal; and wherein the means for initiating an action can identify contact with a portion of the electrically conductive grid and can initiate an action based upon the identification of the contact.

12. The apparatus of claim 11, wherein the means for initiating an action includes a mechanism to erase computer executable instructions stored in a memory.

13. The apparatus of claim 11, wherein the means for initiating an action includes a mechanism to initiate the destruction of an item selected from the group including:

a biological item;

a chemical item;

an electrical item; and a radioactive item.

14. The apparatus of claim 11, wherein the means for initiating an action can identify breakage of a portion of the electrically conductive grid and can initiate an action based upon the identification of the breakage.

15. An apparatus, comprising:

a container having a number of alls;

an electrically conductive layer formed from multiple conductive paths; and encapsulated within a wall surface forming an inter space;

a power source for providing an electrical signal to the electrically conductive layer;

a monitoring unit for detecting changes to the electrical signal; and an actuator for initiating an action based upon information received from the monitoring unit; and wherein the electrically conductive layer substantially encapsulates an interior space and wherein the power source and monitoring unit are oriented within the interior space formed via the encapsulation by the electrically conductive layer.

16. The apparatus of claim 15, wherein the monitoring unit is connected to the electrically conductive grid such that a location of a change in resistance can be determined on the grid.

17. The apparatus of claim 15, wherein the electrically conductive grid is uniformly patterned.

18. The apparatus of claim 15, wherein the number of walls are flexible.

* * * * *